US010427847B2

(12) United States Patent
Tiesberger et al.

(10) Patent No.: US 10,427,847 B2
(45) Date of Patent: Oct. 1, 2019

(54) CONTAINER WITH A CHILD-PROOF LOCK

(71) Applicant: Sanner GmbH, Bensheim (DE)

(72) Inventors: Kai Tiesberger, Sandhausen (DE); Matthias Schneider, Heidesheim (DE)

(73) Assignee: SANNER GMBH, Bensheim (DE)

( * ) Notice: Subject to any disclaimer, the term of this patent is extended or adjusted under 35 U.S.C. 154(b) by 0 days.

(21) Appl. No.: 15/550,013

(22) PCT Filed: Feb. 10, 2016

(86) PCT No.: PCT/EP2016/052776
§ 371 (c)(1),
(2) Date: Aug. 9, 2017

(87) PCT Pub. No.: WO2016/128431
PCT Pub. Date: Aug. 18, 2016

(65) Prior Publication Data

US 2018/0093805 A1 Apr. 5, 2018

(30) Foreign Application Priority Data

Feb. 11, 2015 (DE) ..... 10 2015 101 946

(51) Int. Cl.
*B65D 41/32* (2006.01)
*B65D 41/46* (2006.01)
(Continued)

(52) U.S. Cl.
CPC ..... *B65D 55/0818* (2013.01); *B65D 50/045* (2013.01); *B65D 50/065* (2013.01); *B65D 55/06* (2013.01)

(58) Field of Classification Search
CPC ..... B65D 55/0818; B65D 50/045; B65D 50/065; B65D 55/06
(Continued)

(56) References Cited

U.S. PATENT DOCUMENTS 4,444,326 A 4/1984 Musel
4,540,098 A 9/1985 Luker
(Continued)

FOREIGN PATENT DOCUMENTS

EP 2 067 718 A1 6/2009
FR 2 346 235 A1 10/1977

OTHER PUBLICATIONS

English language translation of the International Preliminary Report on Patentability~ Chapter I including the Written Opinion of the International Searching Authority for International Patent Application No. PCT/EP2016/052776 dated Aug. 15, 2017; 8 pages.
(Continued)

*Primary Examiner* — J. Gregory Pickett
*Assistant Examiner* — Niki M Eloshway
(74) *Attorney, Agent, or Firm* — Dean W. Amburn; Giroux Ambum PC

(57) ABSTRACT

A container having a childproof safety device is provided. The container has a container body with a container opening, comprising a container closure for the container opening, said closure being movable from a closed to an open position, and comprising a removable tamper-proof element. A child safety device that comprises an actuating element is associated with the container closure. The invention is characterized in that the tamper-proof element blocks movement of at least a portion of the actuating element and in that after the tamper-proof element is removed at least a portion of the actuating element is movable from a first position, in which the container closure is secured, to a second position, in which the container closure is not secured.

14 Claims, 8 Drawing Sheets

(51) Int. Cl.

| | |
|---|---|
| ***B65D 55/08*** | (2006.01) |
| ***B65D 50/04*** | (2006.01) |
| ***B65D 50/06*** | (2006.01) |
| ***B65D 55/06*** | (2006.01) |
| *B65D 41/58* | (2006.01) |

(58) Field of Classification Search
USPC ..... 215/201, 213, 211, 225, 253
See application file for complete search history.

(56) References Cited

U.S. PATENT DOCUMENTS

| | | | | |
|---|---|---|---|---|
| 4,979,648 | A * | 12/1990 | Montgomery ..... | B65D 47/243 215/201 |
| 5,602,530 | A * | 2/1997 | Holmgren ..... | E05B 73/0017 215/201 |
| 2006/0070970 | A1 * | 4/2006 | Shingle ..... | B65D 50/041 215/220 |
| 2010/0294791 | A1 | 11/2010 | Weibel et al. | |

OTHER PUBLICATIONS

International Search Report for International Patent Application No. PCT/EP2016/052776 completed Jan. 4, 2016; dated Mar. 23, 2016; 3 pages (foreign ISR); 2 pages (translated ISR).

Written Opinion for International Patent Application No. PCT/EP2016/052776 dated Aug. 18, 2016; 6 pages.

Machine-Assisted English language translation of the abstract, specification and claims of French Publication No. FR 2 346 235 A1 extracted from www.espacenet.com on Jul. 26, 2017; 5 pages.

* cited by examiner

CONTAINER WITH A CHILD-PROOF LOCK

CROSS-REFERENCE TO RELATED APPLICATIONS

This application is the National Stage of International Patent Application No. PCT/EP2016/052776, filed Feb. 10, 2016, which claims priority to and all the advantages of German Patent Application No. 10 2015 101 946.9, filed Feb. 11, 2015, the entire contents of which are hereby incorporated by reference.

TECHNICAL FIELD

The invention relates to a container comprising a container body having a container opening, comprising a container closure for the container opening, said closure being movable from a closed to an open position, and comprising a removable tamper-proof element, wherein for the container closure a child safety device having an actuating element is provided.

BACKGROUND

Containers comprising a tamper-proof element are known. For example, European Publication No. EP 2 067 718 A1 discloses a container comprising a tamper-proof element that is irreversibly altered or destroyed when the lid is first opened and thus suitable for indicating that the container is intact. Further, European Publication No. EP 2 067 718 A1 mentions that a conventional child safety device can additionally be provided. A disadvantage of the previously known container is that it is not as simple and safe to operate as desired.

SUMMARY

The object of the invention is therefore to provide a container comprising a child safety device, which can be operated simply and reliably.

The object is achieved by a container having the features of the invention. Accordingly, a container comprising a container body having a container opening, comprising a container closure for the container opening, said closure being movable from a closed to an open position, and comprising a removable tamper-proof element, wherein for the container closure a child safety device having an actuating element is provided. It is further provided that the tamper-proof element blocks movement of at least a portion of the actuating element and that after the tamper-proof element is removed, at least a portion of the actuating element is movable from a first position, in which the container closure is secured, to a second position, in which the container closure is not secured.

An advantage of the invention is that the container is simple to operate. Further, it is safe to handle. The container closure can only be opened after the tamper-proof element has been removed. The tamper-proof element, which may in particular be a tamper-proof band, shows that the container closure has not yet been opened. In addition, the container can be manufactured in a very simple and cost-effective manner. As a result of the cooperation between the tamper-proof element and the child safety device, improved safety is achieved. The operation is simple and intuitive. At the same time, high safety of the child safety device is still obtained.

An advantageous non-limiting embodiment of the invention provides that the actuating element comprises a sliding body that can be moved from the first to the second position. This configuration can be operated particularly well and safely and is also simple to manufacture. The movement is advantageously parallel to a longitudinal axis of the container body or parallel to a side wall of the container body. The sliding body may be guided for example by the outer side of the container body.

An advantageous non-limiting embodiment of the invention provides that the sliding body has a window and that the tamper-proof element is arranged in the window. Advantageously, the window is of an elongate shape and extends over part of the periphery in the peripheral direction. The window may be formed as an opening in the sliding body.

An advantageous non-limiting embodiment of the invention provides that on the container body, an outward-facing projection is arranged at the container opening and that the tamper-proof element has an inward-facing blocking portion, which, by abutting against the projection, prevents the sliding body from being movable to the second position. If the tamper-proof element has been removed, the sliding body can be moved to the second position. The projection preferably extends transverse to the longitudinal axis of the container body.

An advantageous non-limiting embodiment of the invention provides that the sliding body has a pressure portion for abutting against the container closure. When the sliding body is moved from the first to the second position, the pressure portion of the sliding body preferably abuts against the container closure under pressure so as to move it from the closed to an at least partially open position. It is sufficient for the container closure to be opened far enough that it can be taken off easily as a result.

An advantageous non-limiting embodiment of the invention provides that in the first position, the pressure portion abuts against a rim of the container opening. Preferably, the pressure portion abuts against a front side of the rim. In this way, the pressure portion forms a stop that delimits a movement of the sliding body toward the container bottom.

An advantageous non-limiting embodiment of the invention provides that the sliding body has a cover portion that encompasses the container closure. The cover portion prevents the rim of the container closure from being grippable and openable. The cover portion may be formed as an annular body that extends from the pressure portion parallel to the longitudinal axis of the container body.

An advantageous non-limiting embodiment of the invention provides that the sliding body has a first stop, which delimits a movement of the sliding body in a direction toward the container bottom, and a second stop, which delimits a movement of the sliding body in an opposite direction away from the container bottom. In this way, the sliding body can be prevented from being moved beyond the first or second position. The first stop may be formed by the pressure portion and may, as described, abut against the rim of the container opening. The second stop may be formed by a projection (for example a bead) that extends inward toward the container body from the sliding body.

A further particularly advantageous non-limiting embodiment of the invention provides that the actuating element has a deformation element.

An advantageous non-limiting embodiment of the invention provides that in the first position of the actuating element, the deformation element is spaced apart from an outer side of the container body and that the deformation element can be moved to the second position by finger pressure toward the container body.

An advantageous non-limiting embodiment of the invention provides that in the first position, the actuating element covers the container closure. Preferably, the actuating element covers the rim section of the container closure in such a way that a finger cannot grip it from below.

An advantageous non-limiting embodiment of the invention provides that in the second position, the actuating element uncovers the container closure, in particular the rim section, in such a way that a force can be exerted thereon, in particular using a finger, so as to move it to the open position.

An advantageous non-limiting embodiment of the invention provides that the deformation element is elastically deformable. Preferably, it automatically returns from the second to the first position.

An advantageous non-limiting embodiment of the invention provides that the tamper-proof element is arranged on a rim of the deformation element. Preferably, the tamper-proof element is arranged on the rim of the deformation element facing the container closure.

An advantageous non-limiting embodiment of the invention provides that the tamper-proof covers the container closure. Preferably, the tamper-proof element encloses the outer periphery of the container closure.

An advantageous non-limiting embodiment of the invention provides that the deformation element is annular-shaped.

An advantageous non-limiting embodiment of the invention provides that the deformation element extends parallel to the side wall of the container body.

An advantageous non-limiting embodiment of the invention provides that the deformation element is connected to the container body via a connecting portion. Preferably, the deformation element is manufactured in a single piece with the container body.

An advantageous non-limiting embodiment of the invention provides that the actuating element is annular-shaped.

An advantageous non-limiting embodiment of the invention provides that the actuating element extends around the container body.

An advantageous non-limiting embodiment of the invention provides that the actuating element is arranged on an outer side of the container body.

An advantageous non-limiting embodiment of the invention provides that the container opening is arranged on an end of the container body and that the actuating element is arranged on the same end.

An advantageous non-limiting embodiment of the invention provides that the container body has a container rim that delimits the container opening.

An advantageous non-limiting embodiment of the invention provides that the container closure is formed as a stopper.

An advantageous non-limiting embodiment of the invention provides that the container body has a side wall and a container bottom. Preferably, the container body is cylindrical-shaped.

An advantageous non-limiting embodiment of the invention provides that the tamper-proof element is a tamper-proof band. Preferably, the tamper-proof band is manufactured together with the actuating element in one piece. The tamper-proof element may be connected to the actuating element via tear-off webs.

An advantageous non-limiting embodiment of the invention provides that the container closure has a base and a sealing portion. Preferably, the sealing portion extends from the base toward the container body. The sealing portion may be arranged rectangular to the base. The base may have an outward-facing rim section. In the closed position, the sealing portion is preferably abutting against the inner side of the container body in a sealing manner.

Preferably, the container is an injection-molded part made of plastic. In particular, the container may be manufactured from thermoplastic material, such as polyethylene or polypropylene.

Further objectives, features, advantages and potential applications of the present invention may be derived from the following description of embodiments with reference to the drawings. In this context, all disclosed and/or visually depicted features form the subject matter of the invention in their own right or in any reasonable combination, regardless of how they are combined by way of individual claims or the dependencies thereof.

DETAILED DESCRIPTION

Figure 1:
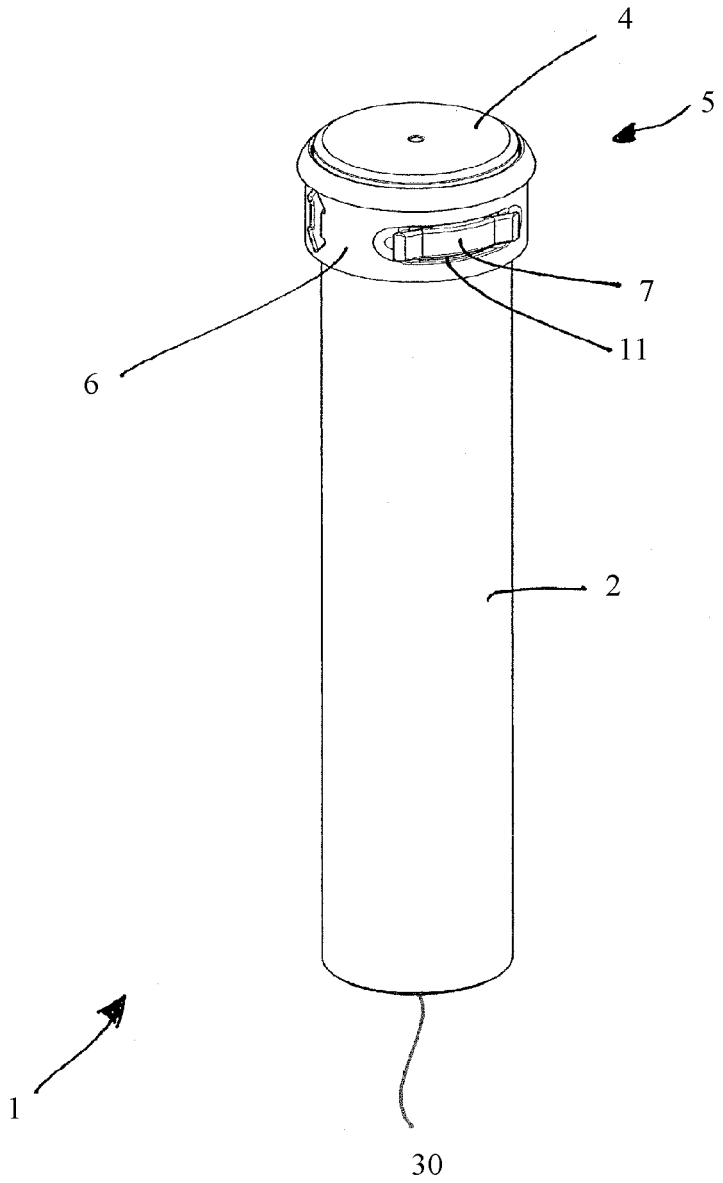
FIG. 1 shows a first perspective view of a container according to the invention in a first embodiment with a sliding body.

Referring to FIGS. 1-8, a container 1 of the invention comprises a container body 2 having a container opening 3. Further, a container closure 4 is provided, which is formed as a stopper in the embodiments shown. The container 1 has a child safety device 5 comprising an actuating element 6. Further, a removable tamper-proof element 7 is provided. The container body 2 is tubular and has a container bottom 30 on its side opposite the opening.

The container closure 4 shown in the embodiment has a base 13 in each case. A sealing portion 14 is arranged on said base 13. The sealing portion 14 is annular-shaped. It is arranged in such a way that it extends a distance into the container body 2 when the container closure 4 is located in the closed position. The sealing portion 4 is then positioned on the inner side of the container body 2 in a sealing manner. In addition, the base 13 has an outward-facing rim section 15. This may in particular be formed as a grip portion that can be gripped by fingers for opening.

The container closure 4 shown has further a desiccant chamber 16, in which a desiccant (not shown), such as silica gel, can be accommodated. The container closure 4 further has a resilient element 17 to reduce movements of objects accommodated in the container body 2. The container 1 is suitable in particular for tablets, such as effervescent tablets.

FIGS. 1 to 5 show a first embodiment of the invention. On the container body 2, an outward-facing projection 8 is arranged at the container opening 3. The projection 8 is formed peripherally. The tamper-proof element 7 has an inward-facing blocking portion 9, which is engaged with the projection 8 and prevents the actuating element 6 from being moved from the first position shown in FIG. 2 to the second position as long as the tamper-proof element 7 has not been removed.

Figure 2:
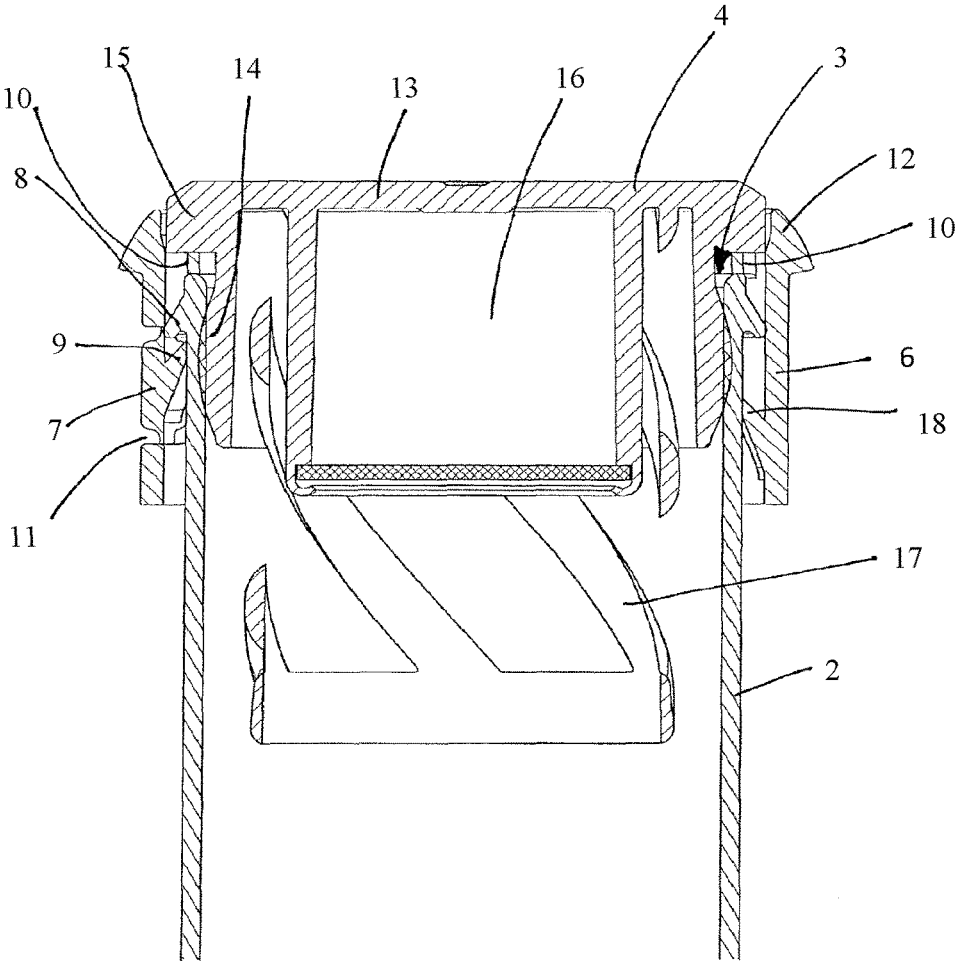
FIG. 2 shows a portion of the container of FIG. 1 in longitudinal section with a tamper-proof element.

In the embodiment shown in FIGS. 1 to 5, the actuating element 6 is designed as a sliding body. FIG. 2 shows the container body 2 having the tamper-proof element 7. The filled container 1 may be delivered in this form.

Figure 3:
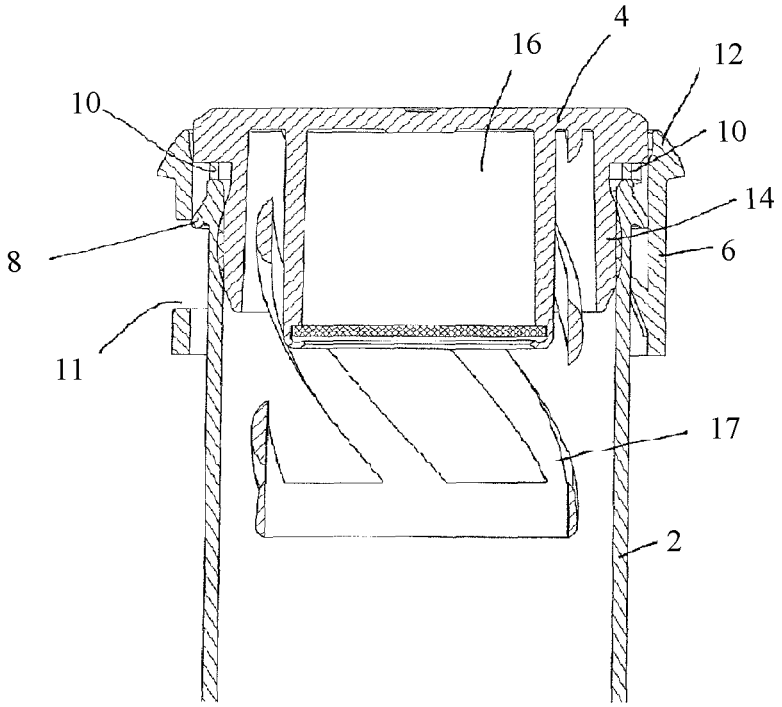
FIG. 3 shows a portion of the container of FIG. 2 in longitudinal section with a removed tamper-proof element, wherein the sliding body is located in the first position.
Figure 4:
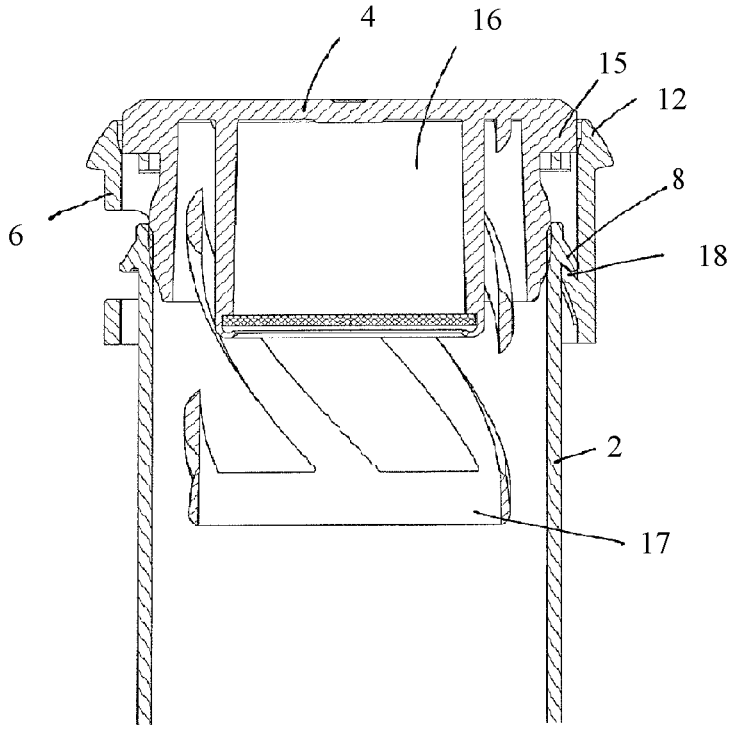
FIG. 4 shows a portion of the container of FIG. 3, wherein the sliding body is located in the second position.

Once the tamper-proof element 7 has been removed, the sliding body can be moved by sliding from the first position, which is shown in FIG. 3, to the second position, which is shown in FIG. 4. The tamper-proof element 7 can be removed by pulling using fingers. The sliding body is being moved along a displacement path parallel to the longitudinal axis of the container body 2 and parallel to the side wall of the container body 2.

The actuating element 6 (sliding body) has a pressure portion 10. The pressure portion 10 abuts against the container closure 4 when the sliding body is moved from the first position to the second position. In doing so, the pressure portion 10 moves the container closure 4 from the closed position (see FIG. 3) to a partially opened position (see FIG. 4). In the embodiment shown, the pressure portion 10 is designed to abut against the rim section 15.

Figure 5:
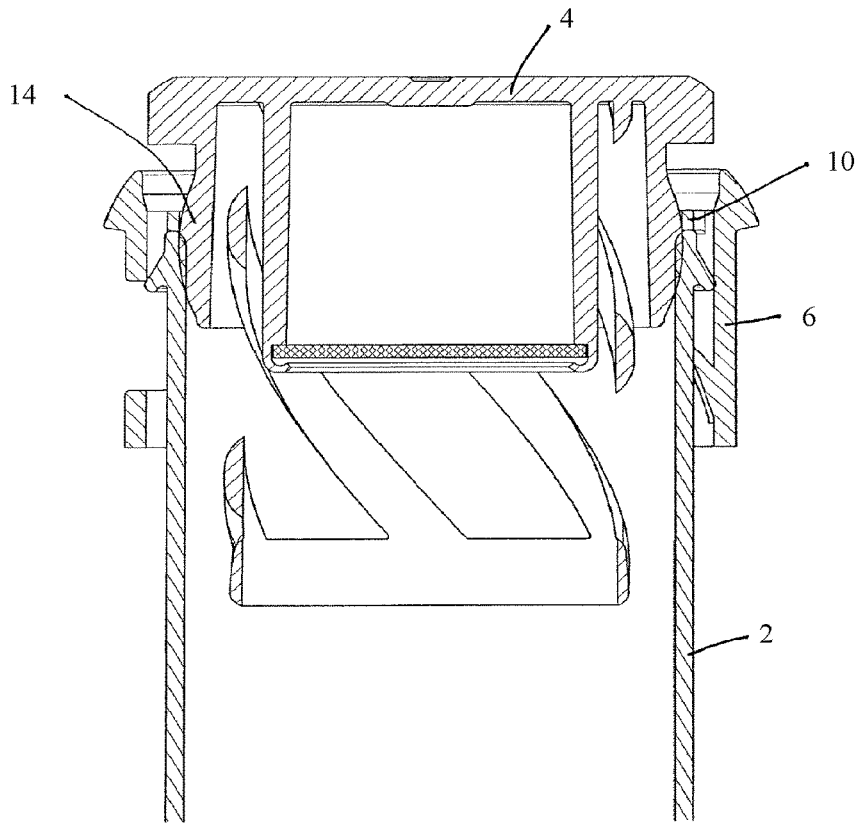
FIG. 5 shows a portion of the container of FIG. 4, the sliding body being located in the first position again.

Once the actuating element 6 has been brought to the second position shown in FIG. 4, the actuating element 6 is moved back to the first position (cf. FIG. 5). Now, the container closure 4, which has not been moved back, can easily be gripped by hand and removed. The rim section 15 of the container closure 4 is now no longer covered by the cover portion 12, which is disclosed in greater detail below.

In the first position of the sliding body, the pressure portion 10 abuts against a rim of the container opening 3. This can be seen in FIGS. 2 and 5. As shown, the pressure portion 2 abuts against a front side of the rim. In this way, the pressure portion 10 forms a first stop that delimits the movement of the sliding body toward the container bottom 30.

Further, a second stop 18 is provided, which delimits a movement of the sliding body away from the container bottom 30. The second stop 18 is provided on the actuating element 6. In this way, the sliding body can be prevented from being moved beyond the first position. The second stop is formed by an inward-facing projection of the sliding body, which in the second position abuts against the projection 8 of the container body 2.

The sliding body has a window 11. The tamper-proof element 7 is arranged in the window 11. As shown in FIG. 1, the window 11 is of an elongate shape and extends in the peripheral direction. The shape of the tamper-proof element 7 substantially corresponds to the one of the window 11. The actuating element 6 is manufactured together with the tamper-proof element 7 as a cohesive injection-molded part. The tamper-proof element 7 is connected to the actuating element 6 via tear-off webs. An end of the tamper-proof element 7 can be gripped by using fingers so as to remove the tamper-proof band 7 and thus to release it from the actuating element 6.

FIGS. 1 to 5 further show that the actuating element 6 (sliding body) has a cover portion 12 that encompasses the container closure 4. The cover portion 12 is in particular an annular-shaped cover that encompasses the rim of the container closure 4 and covers it so far that the container closure 4, in particular the rim section 15 thereof, cannot be gripped using fingers as long as the container closure 4 is located in the closed position and the actuating element 6 is located in the first position.

Figure 6:
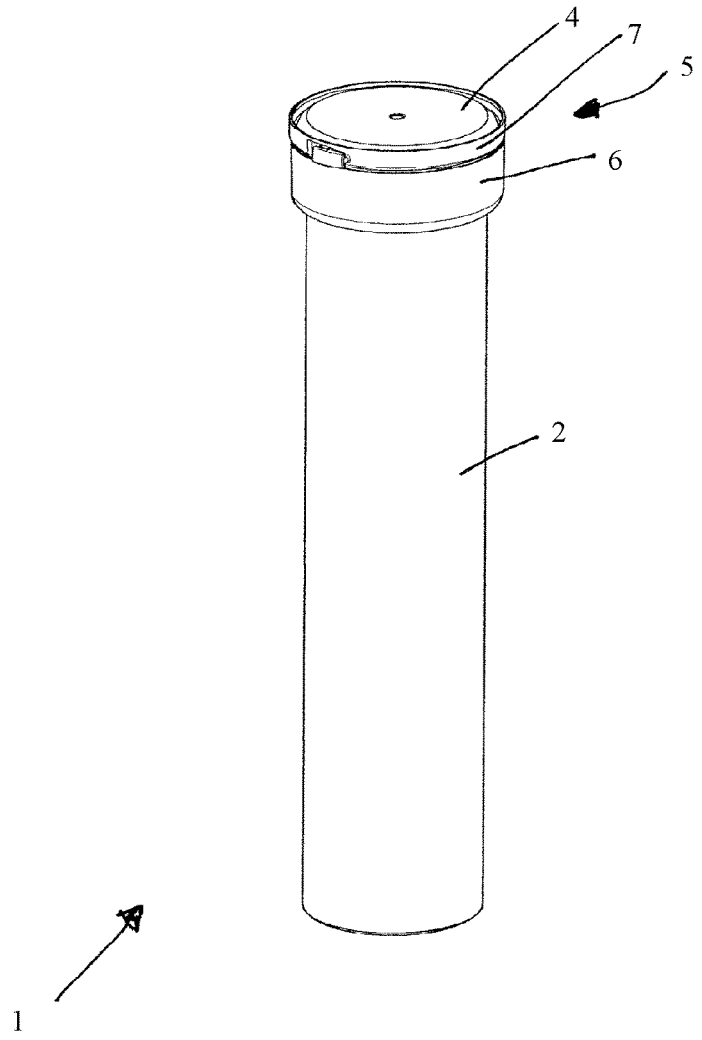
FIG. 6 shows a perspective drawing of a container according to the invention in a second embodiment with a deformation element.
Figure 7:
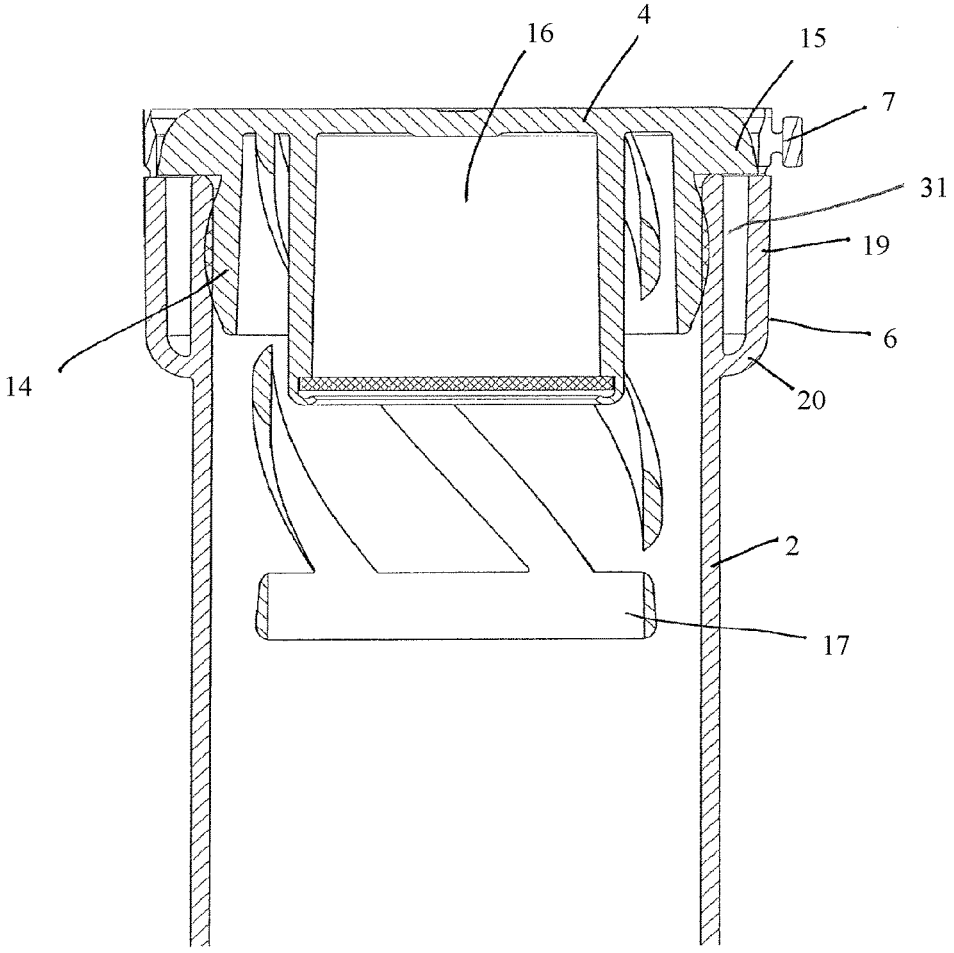
FIG. 7 shows a portion of the container of FIG. 6 in longitudinal section with a tamper-proof element.
Figure 8:
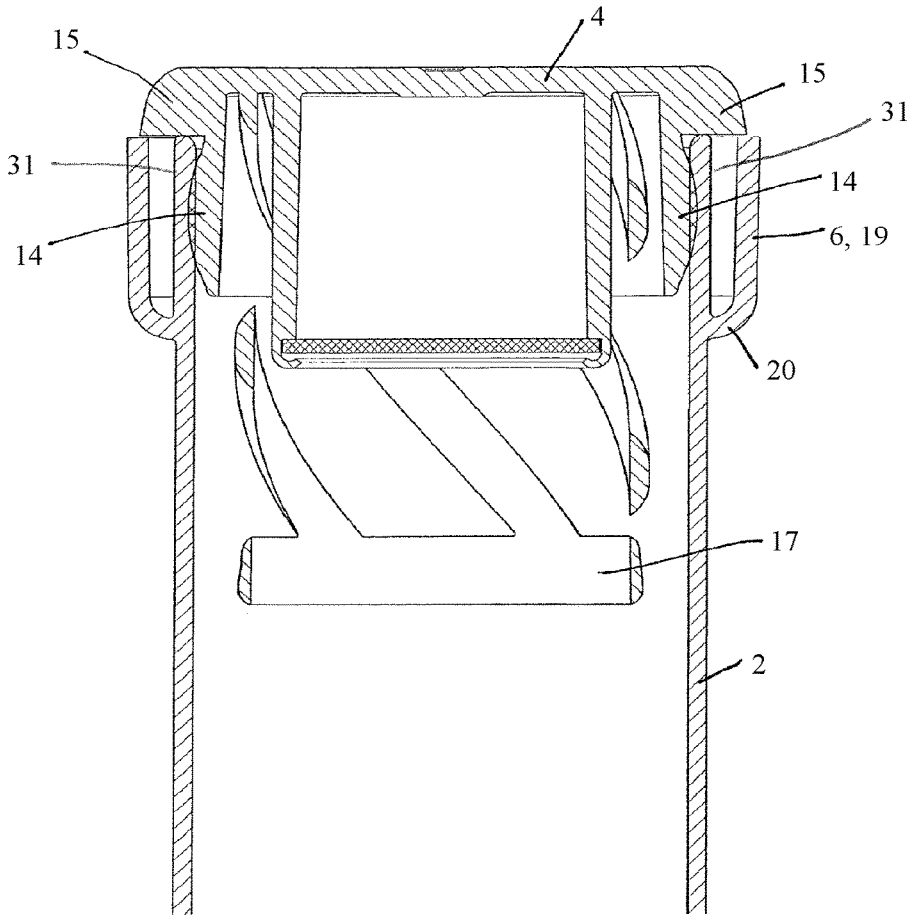
FIG. 8 shows a portion of the container of FIG. 7 in longitudinal section without a tamper-proof element.

FIGS. 6 to 8 show a second embodiment of the invention. Here, the same reference numbers are used for functionally equivalent parts, even if the parts are formed differently. In order to avoid repetitions, reference is made to the description of FIGS. 1 to 5, which applies accordingly to FIGS. 6 to 8 insofar as these are analogous.

In the embodiment shown in FIGS. 6 to 8, the actuating element 6 has a deformation element 19. The deformation element 19 is formed by an annular section that extends around the container body 2.

As shown in FIGS. 7 and 8, the deformation element 19 is spaced apart from an outer surface 31 of the container body 2 in the first position of the actuating element 6. The deformation element 19 can be moved to the second position (not shown) by finger pressure toward the container body 2. In this context, an end portion of the deformation element 19 moves under the rim section 15 of the container closure 4. In this way, when the deformation element 19 is pressed in, the container closure 4 and in particular the rim section 15 can easily be gripped and moved to the open position using a finger. The deformation element 19 is resilient and moves back to the position shown in FIG. 7 when the finger pressure is reduced.

In the first position, shown in FIGS. 7 and 8, the actuating element 6 covers the rim section 15 of the container closure 4 in such a way that a finger cannot engage it from below.

From FIGS. 7 and 8, it can further be seen that the deformation element 19 is connected to the container body 2 via a connecting portion 20. The end of the deformation element 19 opposite the connecting portion 20 forms a free end and enables an easy deformation by finger pressure.

FIG. 7 further shows that the tamper-proof element 7 is arranged on a rim of the deformation element 19. In this context, the tamper-proof element 7 is connected to the deformation element 19 via tear-off webs. It can be seen in FIG. 7 that the tamper-proof element 7 is arranged on a rim of the deformation element 19. In the present case, the tamper-proof element 7 is arranged on the free end of the deformation element 19. The tamper-proof element 7 is arranged on the rim of the deformation element 19 facing the container closure 4. In this context, the tamper-proof element 7 is annular-shaped and extends around the rim section 15. It encloses an outer periphery of the container closure 4. As long as the tamper-proof element 7 is not removed, the deformation element 19 cannot be pressed inward to uncover the rim of the container closure 4. The fact that the tamper-proof element 7 abuts against the rim section 15 of the container closure 4 under pressure from the outside to the inside and therefore blocks an inward movement, prevents the deformation element 19 from moving inward.

FIG. 8 shows the container 1 with the tamper-proof element 7 removed. Now, the deformation element 19 can be pressed inward below the rim section 15 so as to remove the container closure 4. The container 1 is still child-safe, since the sequence of coordinated movements required for opening provides protection against unintentional opening.

The invention claimed is:

1. A container comprising:

a container body having a container opening;

a container closure for the container opening, said closure being movable from a closed to an open position; and a removable tamper-proof element, wherein the container closure comprises a child safety device having an actuating element wherein the tamper-proof element blocks movement of at least a portion of the actuating element and wherein after the tamper-proof element is removed, at least a portion of the actuating element is movable from a first position, in which the container closure is secured, to a second position, in which the container closure is not secured, wherein the actuating element has a sliding body that can be moved from the first to the second position, and wherein the sliding body has a window wherein the tamper-proof element is arranged in the window.

2. The container according to claim 1, characterized in that the actuating element is annular-shaped.

3. The container according to claim 1, characterized in that in the first position, the actuating element covers the container closure in such a way that a finger cannot grip it from below and in the second position, the actuating element uncovers the container closure in such a way that a force can be exerted thereon, in particular using a finger, so as to move it to the open position.

4. The container according I claim 1, wherein the actuating element has a sliding body that can be moved from the first to the second position.

5. The container according to claim 4, wherein the sliding body has a cover portion that encompasses the container closure.

6. The container according to claim 1, wherein the actuating element has a deformation element.

7. The container according to claim 6, wherein for the first position of the actuating element, the deformation element is spaced apart from an outer surface of the container body and in that the deformation element can be moved to the second position by finger pressure toward the container body.

8. The container according to claim 6, wherein the deformation element is connected to the container body via a connecting portion.

9. The container according to claim 6, wherein the deformation element extends parallel to a side wall of the container body.

10. The container according to claim 6, wherein the tamper-proof element is arranged on a rim of the deformation element.

11. The container according to claim 6, wherein the tamper-proof element encloses an outer periphery of the container closure.

12. A container comprising:

a container body having a container opening;

a container closure for the container opening, said closure being movable from a closed to an open position; and a removable tamper-proof element wherein the container closure comprises a child safety device having an annular-shaped actuating element wherein the tamper-proof element blocks movement of at least a portion of the actuating element and, wherein after the tamper-proof element is removed, at least a portion of the actuating element is slideably movable in a direction towards the container closure wherein the container closure is urged by the actuating element to at least a partially open position, wherein the container closure is then unsecured and removable.

13. A container comprising:

a container body having a container opening;

a container closure for the container opening, said closure being movable from a closed to an open position; and a removable tamper-proof element, wherein the container closure comprises a child safety device having an actuating element wherein the tamper-proof element blocks movement of at least a portion of the actuating element and wherein after the tamper-proof element is removed, at least a portion of the actuating element is movable from a first position, in which the container closure is secured, to a second position, in which the container closure is not secured, wherein the actuating element has a sliding body that can be moved from the first to the second position, wherein on the container body, an outward-facing projection is arranged at the container opening, wherein the tamper-proof element has an inward-facing blocking portion, wherein the blocking portion, by abutting against the projection, prevents the sliding body from being movable to the second position.

14. A container comprising:

a container body having a container opening;

a container closure for the container opening, said closure being movable from a closed to an open position; and a removable tamper-proof element, wherein the container closure comprises a child safety device having an actuating element wherein the tamper-proof element blocks movement of at least a portion of the actuating element and wherein after the tamper-proof element is removed, at least a portion of the actuating element is movable from a first position, in which the container closure is secured, to a second position, in which the container closure is not secured, wherein the actuating element has a sliding body that can be moved from the first to the second position, wherein the sliding body has a pressure portion for abutting against the container closure, wherein when the sliding body is moved from the first to the second position, the pressure portion thereof is abutting against the container closure under pressure so as to move it from the closed to an at least partially open position, wherein in the first position, the pressure portion abuts against a front side of the rim of the container opening.

* * * * *